US009052626B2

(12) United States Patent
Miyamoto

(10) Patent No.: US 9,052,626 B2
(45) Date of Patent: Jun. 9, 2015

(54) TONER FOR ELECTROSTATIC LATENT-IMAGE DEVELOPMENT AND METHOD FOR PRODUCING THE SAME

(71) Applicant: KYOCERA Document Solutions Inc., Osaka-shi (JP)

(72) Inventor: Hidetoshi Miyamoto, Osaka (JP)

(73) Assignee: KYOCERA DOCUMENT SOLUTIONS INC., Osaka-Shi (JP)

( * ) Notice: Subject to any disclaimer, the term of this patent is extended or adjusted under 35 U.S.C. 154(b) by 58 days.

(21) Appl. No.: 13/950,078

(22) Filed: Jul. 24, 2013

(65) Prior Publication Data

US 2014/0030648 A1 Jan. 30, 2014

(30) Foreign Application Priority Data

Jul. 27, 2012 (JP) ..... 2012-167389
Jun. 21, 2013 (JP) ..... 2013-130657

(51) Int. Cl.
*G03G 9/093* (2006.01)

(52) U.S. Cl.
CPC ..... *G03G 9/09321* (2013.01); *G03G 9/09364* (2013.01); *G03G 9/09392* (2013.01)

(58) Field of Classification Search
CPC ..... G03G 9/0804; G03G 9/0825; G03G 9/08708; G03G 9/08711; G03G 9/08788; G03G 9/08791; G03G 8/09307; G03G 9/09314; G03G 9/09321
See application file for complete search history.

(56) References Cited

U.S. PATENT DOCUMENTS

2012/0328979 A1* 12/2012 Yoshizaki et al. ..... 430/110.4

FOREIGN PATENT DOCUMENTS

JP 2009-180781 A 8/2009

* cited by examiner

*Primary Examiner* — Peter Vajda
(74) *Attorney, Agent, or Firm* — Knobbe Martens Olson & Bear LLP

(57) ABSTRACT

In a toner for electrostatic latent-image development that includes toner core particles including at least a binder resin, and shell layers with which the entire surfaces of the toner core particles are coated, an ethylene-unsaturated carboxylic acid copolymer is present at the interface between the toner core particle and the shell layer.

4 Claims, 1 Drawing Sheet

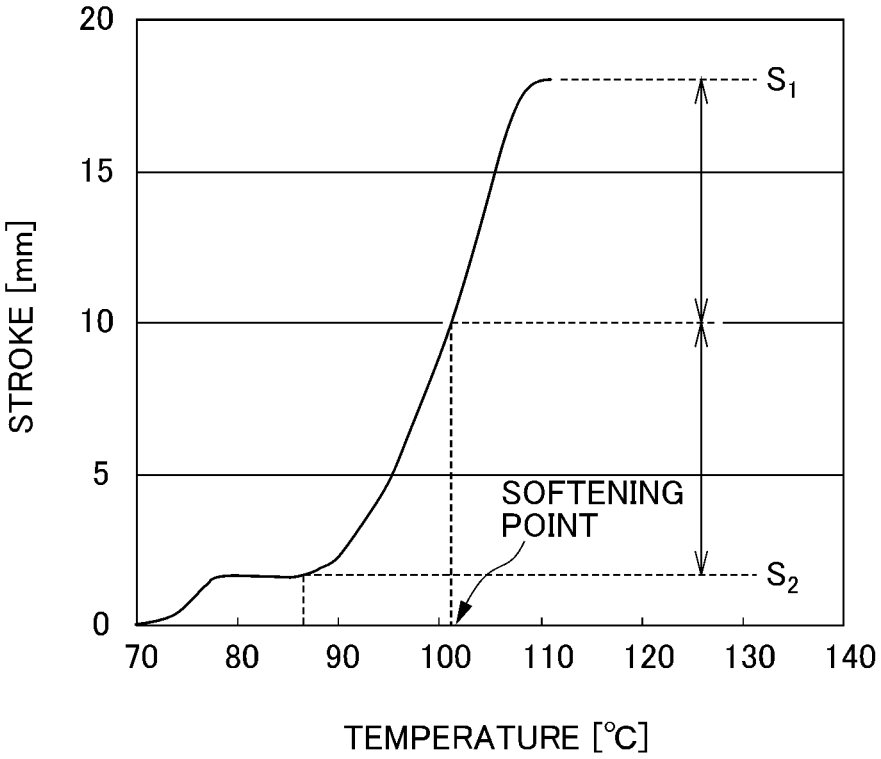
20
15
10
5
0
STROKE [mm]
70
80
90
100
110
120
130
140
TEMPERATURE [°C]
S1
S2
SOFTENING
POINT

TONER FOR ELECTROSTATIC LATENT-IMAGE DEVELOPMENT AND METHOD FOR PRODUCING THE SAME

INCORPORATION BY REFERENCE

This application is based upon and claims the benefit of priority from the corresponding Japanese Patent Application Nos. 2012-167389, and 2013-130657 respectively filed in the Japan Patent Office on Jul. 27, 2012 and Jun. 21, 2013, the entire contents of which are incorporated herein by reference.

FIELD

The present disclosure relates to a toner for electrostatic latent-image development, and to a method for producing the same.

BACKGROUND

In general, in electrophotography, the surface of a photoconductor drum is charged by a method such as corona discharge, followed by exposure using a laser etc. to form an electrostatic latent image. The formed latent image is developed with a toner so as to from a toner image. The formed toner image is transferred onto a recording medium to obtain an image with high quality. The toner used for formation of a toner image is typically a toner including toner particles (toner base particles) with an average particle diameter of 5 μm or larger and 10 μm or smaller produced by mixing a binder resin such as thermoplastic resin with components such as a colorant, a charge control agent and a release agent, followed by a kneading step, a pulverization step and a classification step. For the purpose of providing flowability or suitable charging performance for the toner particles, and/or for facilitating cleaning of the toner particles from the surface of the photoconductor drum, silica and/or inorganic fine particles such as those of titanium oxide are externally added to the toner base particles.

As to the toner particles in the toner described above, toner particles with excellent low-temperature fixability that can be satisfactorily fixed without heating a fixing roller where possible is desired from the viewpoint of energy savings, downsizing of equipment and so on. However, toner particles with excellent low-temperature fixability often tends to agglomerate when stored at high temperatures, and is susceptible to offset resulting from fusion of the toner particles to a heated fixing roller. This is because toner particles in the toner with excellent low-temperature fixability often contains a binder resin having a low melting point and a low glass transition point, as well as a release agent having a low melting point.

In view of the circumstances described above, for the purpose of improving the fixability of a toner to a sheet and offset resistance, a toner which includes toner particles containing a binder resin composed of a vinyl resin and an ionomer resin has been proposed.

For the toner particles in the above-described toner, however, fixability to a sheet and offset resistance are improved, but the level of improvement for fixability is inadequate. Therefore, for the above-described toner, further improvement of low-temperature fixability is desired. When an image with a low printing rate is formed over a long period of time, the toner particles in the above-described toner tend to be crushed if the toner particles are placed under stress over a long period of time as a result of stirring. In this case, a component such as a release agent contained in the toner particles tend to seep out onto the surfaces of the toner particles. When a component such as a release agent seeps out onto the surfaces of the toner particles, the storage stability of the toner particles at high temperatures is impaired.

SUMMARY

A toner for electrostatic latent-image development according to one aspect of the present disclosure includes:

toner particles containing at least a toner core particle including at least a binder resin; and a shell layer with which the toner core particles are coated. An ethylene-unsaturated carboxylic acid copolymer is present at the interface between the toner core particle and the shell layer. The shell layer includes a (meth)acrylic resin and/or a styrene-(meth)acrylic resin.

A method for producing a toner for electrostatic latent-image development according to another aspect of the present disclosure includes steps (I) to (V):

(I): obtaining an aqueous dispersion (A) containing fine particles including a binder resin, followed by aggregation of the fine particles in the presence of an aggregating agent to obtain an aqueous dispersion (B) containing toner core particles;

(II): mixing the aqueous dispersion (B) with an aqueous dispersion (C) containing fine particles including an ethylene-unsaturated carboxylic acid copolymer to obtain an aqueous dispersion (D) containing the toner core particles and the fine particles of the ethylene-unsaturated carboxylic acid copolymer;

(III): heating the aqueous dispersion (D) to obtain an aqueous dispersion (E) containing toner core particles with the fine particles of the ethylene-unsaturated carboxylic acid copolymer attached on the surface;

(IV): mixing the aqueous dispersion (E) with an aqueous dispersion (F) containing resin fine particles composed of a resin including a (meth)acrylic resin and/or a styrene-(meth)acrylic resin to obtain an aqueous dispersion (G) containing toner core particles with the fine particles of the ethylene-unsaturated carboxylic acid copolymer attached on the surface, and the resin fine particles; and (V): obtaining toner particles by heating the aqueous dispersion (G) to form shell layers on the surfaces of the toner core particles.

BRIEF DESCRIPTION OF DRAWINGS

FIG. 1 is a view that illustrates a method of measuring a softening point using an elevated flow tester.

DETAILED DESCRIPTION

The present disclosure is explained in detail with respect to embodiments thereof below; however, the present disclosure is not limited at all to the embodiments and may be carried out with appropriately making a change within the purpose of the present disclosure. In addition, explanation may be occasionally omitted with respect to duplicated matters; this does not however limit the gist of the present disclosure.

First Embodiment

The first embodiment of the present disclosure relates to a toner for electrostatic latent-image development (hereinafter, also referred to as the "toner"). The toner for electrostatic latent-image development according to the first embodiment includes toner particles each containing toner core particle including at least a binder resin and shell layer with which the entire surface of the toner core particle is coated. An ethylene-unsaturated carboxylic acid copolymer is present at the interface between the toner core particle and the shell layer. The toner according to the first embodiment of the present disclosure may consist of only the toner particles, and consist of the toner particles and the component other than the toner particles.

The toner particles in the toner according to the first embodiment of the present disclosure may have an external additive attached on the surface. The toner of the present disclosure may be mixed with a carrier and used as a two-component developer as required. For the toner according to the first embodiment of the present invention, the toner core particle, the shell layer, the ethylene-unsaturated carboxylic acid copolymer and the external additive, and the carrier, when the toner is used as a two-component developer, are explained in order below.

Toner Core Particle

The toner particles in the toner of the present disclosure each include toner core particle and shell layer with which the toner core particles is coated. The toner core particle essentially includes a binder resin. The toner core particle may include optional components such as a release agent, a colorant, a charge control agent and a magnetic powder in the binder resin as required. For the toner core particle, the binder resin, the release agent, the colorant, the charge control agent and the magnetic powder, which are essential or optional components, are explained in order below.

Binder Resin

The binder resin contained in the toner core particle may be appropriately selected from resins used as binder resins for toners heretofore. Preferably the binder resin includes a polyester resin. When a toner is prepared with toner core particles including a binder resin including a polyester resin, a toner including toner particles with excellent low-temperature fixability and color development is easily prepared. The polyester resin to be used as the binder resin may be appropriately selected from polyester resins used as binder resins for toners heretofore. As the polyester resin, one obtained by condensation polymerization or condensation copolymerization of an alcohol component and a carboxylic acid component may be used. Examples of the component to be used when the polyester resin is synthesized include the following divalent, trivalent or higher-valent alcohol components and divalent, trivalent or higher-valent carboxylic acid components.

Specific examples of the divalent, trivalent or higher-valent alcohols may be exemplified by diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol; bisphenols such as bisphenol A, hydrogenated bisphenol A, polyoxyethylenated bisphenol A, and polyoxypropylenated bisphenol A; and trivalent or higher-valent alcohols such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the divalent, trivalent or higher-valent carboxylic acids include divalent carboxylic acids such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, or alkyl or alkenyl succinic acids including n-butyl succinic acid, n-butenyl succinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid; and trivalent or higher-valent carboxylic acids such as 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra (methylenecarboxyl)methane, 1,2,7,8-octanetetracarboxylic acid, pyromellitic acid, and Enpol trimer. These divalent, trivalent or higher-valent carboxylic acids may be used as ester-forming derivatives such as an acid halide, an acid anhydride, and a lower alkyl ester. Here, the term "lower alkyl" means an alkyl group of from 1 to 6 carbon atoms.

The acid value of the polyester resin is preferably 10 mg KOH/g or higher and 40 mg KOH/g or lower. When the toner core particles are prepared using a binder resin including a polyester resin having an excessively low acid value, it may be difficult for aggregation of fine particles to proceed properly, depending on the formulation in step (II) included in the method for producing a toner according to the second embodiment described later. In the case of a toner including toner particles prepared by using toner core particles containing a binder resin including a polyester resin having an excessively high acid value, various properties of the toner tend to be adversely affected by humidity under a high humidity condition. The acid value of the polyester resin may be adjusted by adjusting the balance between the amount of hydroxyl groups of an alcohol component and the amount of carboxyl groups of a carboxylic acid component, to be used for synthesis of the polyester resin.

The softening point of the binder resin is preferably 90° C. or higher and 140° C. or lower. When an image is formed using a toner including toner particles prepared by using toner core particles containing a binder resin having an excessively high softening point, it is difficult to properly fix the toner at low temperatures. When a toner including toner particles prepared by using toner core particles containing a binder resin having an excessively low softening point is used, the toner may agglomerate when stored at high temperatures. This is because when the toner is prepared by using a binder resin having an excessively low softening point, the heat-resistant storage stability of the toner is impaired. The softening point of the binder resin can be measured by the method described below.

Method for Measurement of Softening Point

The softening point of the binder resin is measured with an elevated flow tester (CFT-500D (manufactured by Shimadzu Corporation)). Specifically, the softening point of the binder resin is measured in the following manner. As a sample, 1.5 g of the binder resin is used. A die having a height of 1.0 mm and a diameter of 1.0 mm is used. A measurement is performed under conditions including a rate of temperature increase of 4° C./min, a preheat time of 300 seconds, a load of 5 kg and a measuring temperature range of from 60° C. to 200° C. (inclusively). The softening point is read from an S-shaped curve that is obtained from the measurement of the binder resin sample with the flow tester and that shows the relation between temperature (° C.) and stroke (mm).

How the softening point is read is explained with reference to FIG. 1. The maximum stroke value is defined as S1, and the baseline stroke value on the lower temperature side is defined as S2. The temperature at which the stroke value is (S1+S2)/2 on the S-shaped curve is defined as the softening point of the binder resin.

The glass transition point (Tg) of the binder resin is preferably 40° C. or higher and 70° C. or lower. When an image is formed using a toner including toner particles prepared by using toner core particles containing a binder resin having an excessively low glass transition point, one or more components in the toner tends to adhere to the latent image-bearing member because the strength of the binder resin is low. When an image is formed using a toner including toner particles prepared by using toner core particles containing a binder resin having an excessively high glass transition point, it may be difficult to properly fix the toner at low temperatures.

The glass transition point of the binder resin can be determined from the point of change in specific heat of the binder resin by using a differential scanning calorimeter (DSC) in accordance with JIS K7121. The specific measuring method is as follows. The glass transition point of the binder resin can be determined by measuring the endothermic curve of the binder resin with a DSC-6200 differential scanning calorimeter manufactured by Seiko Instruments Inc. as a measuring device. Into an aluminum pan 10 mg of a sample to be measured is loaded, and an empty aluminum pan is used as a reference. The glass transition point of the binder resin can be determined from the endothermic curve of the binder resin, which is obtained by performing a measurement at normal temperature and normal humidity under measurement conditions including a measuring temperature range of from 25° C. to 200° C. (inclusively) and a rate of temperature increase of 10° C./minute.

The number-average molecular mass (Mn) of the binder resin is more preferably 3,000 or higher and 20,000 or lower. When the toner core particles are prepared using a binder resin whose number-average molecular mass (Mn) falls within the above-mentioned range, a toner properly fixed over a broad temperature range is obtained. The molecular mass distribution (Mw/Mn) expressed by the ratio of the mass-average molecular mass (Mw) to the number-average molecular mass (Mn) is preferably from 2 or more and 60 or less. When the toner core particles are prepared using a binder resin whose molecular mass distribution falls within the above-mentioned range, a toner with excellent low-temperature fixability is easily obtained. The number-average molecular mass (Mn) and the mass-average molecular mass (Mw) of the binder resin can be measured by gel permeation chromatography.

When the binder resin includes a polyester resin in combination with a thermoplastic resin other than the polyester resin, the thermoplastic resin other than the polyester resin may be appropriately selected from thermoplastic resins used as binder resins for toners heretofore.

When the binder resin includes a polyester resin in combination with a thermoplastic resin other than the polyester resin, the content of the polyester resin in the binder resin is preferably 70% by mass or more, more preferably 80% by mass or more, especially preferably 90% by mass or more, and most preferably 100% by mass.

Release Agent

Toner core particles may contain a release agent as required. The release agent is used to improve the fixability of the toner against sheet and offset resistance. By adding an appropriate amount of release agent to toner core particles, a toner is easily obtained that is capable of efficiently suppressing occurrence of offset and image smearing (smear on the periphery of an image when the image is rubbed) in the formed image. The type of release agent is not particularly limited as long as it has been used as a release agent for a toner.

Preferable release agents may be exemplified by aliphatic hydrocarbon waxes such as low molecular mass polyethylene, low molecular mass polypropylene, polyolefin copolymer, polyolefin wax, microcrystalline wax, paraffin wax, and Fischer-Tropsch wax; oxides of aliphatic hydrocarbon wax such as oxidized polyethylene wax and block copolymer of oxidized polyethylene wax; vegetable waxes such as candelilla wax, carnauba wax, Japan wax, jojoba wax, and rice wax; animal waxes such as bees wax, lanolin, and whale wax; mineral waxes such as ozokerite, ceresin, and petrolatum; waxes containing a fatty acid ester as a main component such as montanate ester wax and castor wax; and waxes obtained by deoxidization of a part or whole of fatty acid ester such as deoxidized carnauba wax.

Further, examples of the release agent that is suitably used include saturated straight-chain fatty acids such as palmitic acid, stearic acid, montanoic acid, and long-chain alkyl carboxylic acids having an alkyl group with a longer chain; unsaturated fatty acids such as brassidic acid, eleostearic acid and parinaric acid; saturated alcohols such as stearyl alcohol, eicosyl alcohol, behenyl alcohol, carnaubyl alcohol, ceryl alcohol, melissyl alcohol, and long-chain alkyl alcohols having an alkyl group with a longer chain; polyhydric alcohols such as sorbitol; fatty acid amides such as linoleic acid amide, oleic acid amide and lauric acid amide; saturated fatty acid bisamides such as methylene bisstearic acid amide, ethylene biscapric acid amide, ethylene bislauric acid amide and hexamethylene bisstearic acid amide; unsaturated fatty acid amides such as ethylene bisoleic acid amide, hexamethylene bisoleic acid amide, N,N'-dioleyladipic acid amide and N,N'-dioleoyl sebacic acid amide and aromatic bisamides such as m-xylene bisstearic acid amide and N,N'-distearylisophthalic acid amide; fatty acid metal salts such as calcium stearate, calcium laurate, zinc stearate and magnesium stearate; waxes obtained by grafting a vinyl monomer such as styrene or acrylic acid to an aliphatic hydrocarbon wax; partially esterified products of a fatty acid and a polyhydric alcohol, such as behenic acid monoglyceride; and methyl ester compounds having a hydroxyl group, which are obtained by hydrogenating a vegetable fat and oil.

The amount of the release agent used is preferably 3% by mass or more and 18% by mass or less, and more preferably 5% by mass or more and 15% by mass or less based on the mass of the toner core particles. When an image is formed using a toner including toner particles prepared by using toner core particles where the content of the release agent is excessively small, the desired effect of suppressing the occurrence of offset and image smearing in the formed image may not be achieved. In the case of a toner including toner particles prepared by using toner core particles where the content of the release agent is excessively large, toner particles may be easily fused together, leading to low storage stability. When the later-mentioned method for producing a toner for electrostatic latent-image development according to the present disclosure is used, detachment of the release agent from the surfaces of the toner particles and seepage of the release agent from the inside of the toner particles are suppressed even when a large amount of the release agent is included in the toner core particles, and therefore a toner having both low-temperature fixability and heat-resistant storage stability is easily obtained.

Colorant

The toner core particle may include a colorant as required. As the colorant compounded with toner core particles, known pigments and dyes may be used, depending on the color of the toner particles. Specific examples of the preferred pigment that may be compounded with the toner include the following colorants.

Examples of black colorants include carbon black. Specific examples of the black colorant include Raven 1060, 1080, 1170, 1200, 1250, 1255, 1500, 2000, 3500, 5250, 5750, 7000, 5000 ULTRA II and 1190 ULTRA II manufactured by Columbian Carbon Ltd.; Black Pearls L, Mogul-L, Rega 1400R, 660R, 330R, Monarch 800, 880, 900, 1000, 1300 and 1400 manufactured by Cabot Corporation; Color Black FW 1, FW 2, FW 200, 18, S 160, S 170, Special Black 4, 4A, and 6 and Printex 35, U, 140U, V and 140V manufactured by Degussa Co.; and No. 25, 33, 40, 47, 52, 900, 2300, MCF-88, MA 600, 7, 8 and 100 manufactured by Mitsubishi Chemical Corporation. As the black colorant, colorants adjusted to black with colorants such as yellow colorants, magenta colorants and cyan colorants as described later may also be used.

Examples of the colorant for a color toner include colorants such as yellow colorants, magenta colorants and cyan colorants.

Examples of the yellow colorant include colorants such as those of condensed azo compounds, isoindolinone compounds, anthraquinone compounds, azo metal complexes, methine compounds and arylamide compounds. Specific examples of the yellow colorant include C.I. pigment yellows 12, 13, 14, 15, 17, 62, 74, 83, 93, 94, 95, 97, 109, 110, 111, 120, 127, 128, 129, 147, 151, 154, 155, 168, 174, 175, 176, 180, 181, 191 and 194.

Examples of the magenta colorant include those of condensed azo compounds, diketo-pyrrolo-pyrrole compounds, anthraquinone compounds, quinacridone compounds, basic dye lake compounds, naphthol compounds, benzimidazolone compounds, thioindigo compounds and perylene compounds. Specific examples of the magenta colorant include C.I. pigment reds 2, 3, 5, 6, 7, 19, 23, 48:2, 48:3, 48:4, 57:1, 81:1, 122, 144, 146, 150, 166, 169, 177, 184, 185, 202, 206, 220, 221 and 254.

Examples of the cyan colorant include those of copper phthalocyanine compounds, copper phthalocyanine derivatives, anthraquinone compounds and basic dye lake compounds. Specific examples of the cyan colorant include C.I. pigment blues 1, 7, 15, 15:1, 15:2, 15:3, 15:4, 60, 62 and 66.

These colorants may be used alone or mixed. The amount of the colorant used is preferably 1 part by mass or more and 30 parts by mass or less based on 100 parts by mass of the toner core particles.

Charge Control Agent

The toner core particles may contain a charge control agent as required. The charge control agent is used for the purpose of improving a charge level stability of the toner particles or a charge-increasing property, which gives an indication of chargeability of toner particles to a predetermined charge level within a short time, to thereby obtain a toner including toner particles with excellent durability and stability. When developing by positively charging the toner particles, a positively chargeable charge control agent is used; and when developing by negatively charging the toner particles, a negatively chargeable charge control agent is used.

The charge control agent may be appropriately selected from those used for toners heretofore. Specific examples of the positively chargeable charge control agent may be exemplified by azine compounds such as pyridazine, pyrimidine, pyrazine, ortho-oxazine, meta-oxazine, para-oxazine, ortho-thazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes consisting of azine compounds such as azine Fastred FC, azine Fastred 12BK, azine Violet BO, azine Brown 3G, azine Light Brown GR, azine Dark Green BH/C, azine Deep Black EW, and azine Deep Black 3RL; nigrosine compounds such as nigrosine, nigrosine salts, and nigrosine derivatives; acid dyes consisting of nigrosine compounds such as nigrosine BK, nigrosine NB, and nigrosine Z; metal salts of naphthenic acid or higher fatty acid; alkoxylated amines; alkylamides; quaternary ammonium salts such as benzylmethylhexyldecyl ammonium and decyltrimethylammonium chloride. Among these positively chargeable charge control agents, nigrosine compounds are particularly preferable since more rapid charge-increasing property of the toner particles may be obtained. These positively chargeable charge control agents may be used in a combination of two or more.

In addition, resins having a quaternary ammonium salt, a carboxylic acid salt, or a carboxyl group as a functional group may be used as the positively chargeable charge control agent. More specifically, styrene resins having a quaternary ammonium salt, acrylic resins having a quaternary ammonium salt, styrene-acrylic resins having a quaternary ammonium salt, polyester resins having a quaternary ammonium salt, styrene resins having a carboxylic acid salt, acrylic resins having a carboxylic acid salt, styrene-acrylic resins having a carboxylic acid salt, polyester resins having a carboxylic acid salt, styrene resins having a carboxylic group, acrylic resins having a carboxylic group, styrene-acrylic resins having a carboxylic group, and polyester resins having a carboxylic group, may be exemplified. These resins may be oligomers or polymers.

Among resins that may be used as the positively chargeable charge control agent, styrene-acrylic resins having a quaternary ammonium salt as a functional group are preferable because the charge value can be easily adjusted to fall within the desired range. Specific examples of the preferable acrylic comonomer copolymerized with styrene monomer in preparation of a styrene-acrylic resin having a quaternary ammonium salt as a functional group include (meth)acrylic acid alkyl esters such as methyl acrylate, ethyl acrylate, n-propyl acrylate, isopropyl acrylate, n-butyl acrylate, isobutyl acrylate, 2-ethylhexyl acrylate, methyl methacrylate, ethyl methacrylate, n-butyl methacrylate and isobutyl methacrylate.

A unit derived through a process of quaternization from dialkylaminoalkyl (meth)acrylate, dialkylamino (meth)acrylamide or dialkylaminoalkyl (meth)acrylamide is used as the quaternary ammonium salt. Specific examples of dialkylaminoalkyl (meth)acrylate include dimethylaminoethyl (meth) acrylate, diethylaminoethyl (meth)acrylate, dipropylaminoethyl (meth)acrylate and dibutylaminoethyl (meth)acrylate. Specific examples of dialkyl (meth)acrylamide include dimethyl (meth)acrylamide. Specific examples of dialkylaminoalkyl (meth) acrylamide include dimethylaminopropyl methacrylamide. In addition, hydroxyl group-containing polymerizable monomers such as hydroxyethyl (meth)acrylate, hydroxypropyl (meth)acrylate, 2-hydroxybutyl (meth) acrylate and N-methylol (meth)acrylate may be used in combination at a polymerization.

Specific examples of the negatively chargeable charge control agent may be exemplified by organic metal complexes and chelate compounds. The organic metal complex and the chelate compound are preferably acetylacetone metal complexes such as aluminum acetylacetonate and iron (II) acetylacetonate and salicylic acid metal complexes or salicylic acid metal salts such as 3,5-di-tert-butylsalicylic acid chromium and more preferably salicylic acid metal complexes or salicylic acid metal salts. These negatively chargeable charge control agents may be used in a combination of two or more.

The amount of the positively or negatively chargeable charge control agent used is preferably 1.5 parts by mass or more and 15 parts by mass or less, more preferably 2.0 parts by mass or more and 8.0 parts by mass or less, and particularly preferably 3.0 parts by mass or more and 7.0 parts by mass or less based on 100 pats by mass of the total amount of the toner. When an image is formed using a toner including toner particles prepared by using toner core particles where the content of the charge control agent is excessively low, it is hard to effect stable charging of the toner particles to a predetermined polarity, and it therefore may be difficult to form an image with a desired image density or difficult to maintain an image density for a long period of time. In this case, there is the tendency for the charge control agent not to be uniformly dispersed in the binder resin in the toner core particles. Therefore, fogging tends to occur in the formed image, or smearing of the latent image-bearing member by one ore more components in the toner particles tends to occur. A toner including toner particles prepared by using toner core particles containing too much charge control agent is poor in environmental resistance. Accordingly, when an image is formed using a toner including toner particles prepared by using toner core particles containing too much charge control agent, problems such as image failure in the formed image and smear of the latent image-bearing member by one or more component in the toner particles tend to occur as a result of poor charge at high temperature and high humidity.

Magnetic Powder

The toner core particle may include a magnetic powder as required. Preferable examples of the magnetic powder may be exemplified by iron oxides such as ferrite and magnetite, ferromagnetic metals such as those of cobalt and nickel, alloys of iron and/or ferromagnetic metals, compounds of iron and/or ferromagnetic metals, ferromagnetic alloys via ferromagnetizing treatment like heat-treatment, and chromium dioxide.

Particle diameter of the magnetic powder is preferably from 0.1 μm to 1.0 μm and more preferably from 0.1 μm to 0.5 μm. When the toner core particles are prepared using a magnetic powder having a particle diameter in the above-described range, a toner core particles with a magnetic powder uniformly dispersed in a binder resin are easily obtained.

A magnetic powder surface-treated with a surface-treatment agent such as a titanium coupling agent or a silane coupling agent may also be used to improve the dispersibility of the magnetic powder in the binder resin.

In cases of using the toner as a one-component developer, the amount of the magnetic powder used is preferably 35 parts by mass or more and 60 parts by mass or less and more preferably 40 pats by mass or more and 60 parts by mass or lass based on 100 parts by mass of the total amount of the toner core particles. When an image is formed using a toner including toner particles prepared by using toner core particles containing too much magnetic powder, it may be difficult to keep the image density of the formed image at a desired value for a long period of time, or the fixability of the toner on a sheet may be extremely degraded. When an image is formed using a toner including toner particles prepared by using toner core particles containing too little magnetic powder, fogging may tend to occur in the formed image, or it may be difficult to keep the image density at a desired value for a long period of time. In cases of using the toner as a two-component developer, the amount of the magnetic powder used is preferably 20 parts by mass or less and more preferably 15 parts by mass or less based on 100 parts by mass of the total amount of the toner core particles.

Shell Layer

The toner particles in the toner of the present disclosure include shell layers with which the surfaces of toner core particles are coated. The material of the shell layer includes a (meth)acrylic resin and/or a styrene-(meth)acrylic resin. These resins have a carbonyl group in their structures. Therefore, a hydrogen bond is formed between the carbonyl group of the (meth)acrylic resin and/or the styrene-(meth)acrylic resin contained in the shell layer and the carboxyl group of an ethylene-unsaturated carboxylic acid copolymer present between the toner core particle and the shell layer. Therefore, in the toner particle in the toner of the first embodiment, the toner core particle and the shell layer are strongly bonded together via the ethylene-unsaturated carboxylic acid copolymer. These resins may be used in a combination of two or more. The (meth)acrylic resin and the styrene-(meth)acrylic resin are explained below.

(Meth)Acrylic Resin

The (meth)acrylic resin used as a resin that forms the shell layer is a resin obtained by polymerizing monomers including at least a (meth)acrylic monomer. Examples of the (meth) acrylic monomer for use in preparation of the (meth)acrylic resin include (meth)acrylic acid; alkyl (meth)acrylates such as methyl (meth)acrylate, ethyl (meth)acrylate and propyl (meth)acrylate; and (meth)acrylamide compounds such as (meth)acrylamide, N-alkyl (meth)acrylamide, N-aryl (meth) acrylamide, N,N-dialkyl (meth)acrylamide and N,N-diaryl (meth) acrylamide.

When the (meth)acrylic resin is a copolymer resin of a (meth)acrylic monomer and a monomer other than the (meth) acrylic monomer, examples of the other monomer include olefins such as ethylene, propylene, butene-1, pentene-1, hexene-1, heptene-1 and octene-1; allyl esters such as allyl acetate, allyl benzoate, allyl acetoacetate and allyl lactate; vinyl ethers such as hexyl vinyl ether, octyl vinyl ether, etylhexyl vinyl ether, methoxyethyl vinyl ether, ethoxyethyl vinyl ether, chloroethyl vinyl ether, 2-ethylbutyl vinyl ether, dimethylaminoethyl vinyl ether, diethylaminoethyl vinyl ether, benzyl vinyl ether, vinyl phenyl ether, vinyl tolyl ether, vinyl chlorophenyl ether, vinyl-2,4-dichlorophenyl ether and vinyl naphthyl ether; and vinyl esters such as vinyl acetate, vinyl propionate, vinyl butylate, vinyl isobutylate, vinyl diethylacetate, vinyl chloroacetate, vinyl methoxyacetate, vinyl butoxyacetate, vinyl phenylacetate, vinyl acetoacetate, vinyl lactate, vinyl benzoate, vinyl salicylate, vinyl chlorobenzoate and vinyl naphthoate.

The (meth)acrylic resin may be one containing a chargeable functional group such as that of a quaternary ammonium salt like the aforementioned resin that can be used as a charge control agent.

The sum of the contents of units derived from the (meth) acrylic monomer in the (meth)acrylic resin is preferably 80% by mass or more, more preferably 90% by mass or more, and especially preferably 100% by mass.

Styrene-(meth)acrylic resin

The styrene-(meth)acrylic resin used as a resin that forms the shell layer is a resin obtained by copolymerizing monomers including at least a styrene monomer and a (meth) acrylic monomer.

Examples of the styrene monomer for use in preparation of the styrene-(meth)acrylic resin include styrene, α-methylstyrene, o-methylstyrene, m-methylstyrene, p-methylstyrene, p-ethylstyrene, 2,4-dimethylstyrene, p-n-butylstyrene, p-dodecylstyrene, p-methoxystyrene, p-phenylstyrene and p-chlorostyrene.

The (meth)acrylic monomer for use in preparation of the styrene-(meth)acrylic resin is similar to the (meth)acrylic monomer for use in preparation of the (meth)acrylic resin.

When the styrene-(meth)acrylic resin is a copolymer resin of a styrene monomer, a (meth)acrylic monomer and a monomer other than the styrene monomer and (meth)acrylic monomer, examples of the other monomer are similar to those of the monomer other than the (meth)acrylic monomer for use in preparation of the (meth)acrylic resin.

The sum of the contents of units derived from the styrene monomer and units derived from (meth)acrylic monomer in the styrene-(meth)acrylic resin is preferably 80% by mass or more, more preferably 90% by mass or more, especially preferably 100% by mass.

The styrene-(meth)acrylic resin may be one containing a chargeable functional group such as that of a quaternary ammonium salt like the aforementioned resin that can be used as a charge control agent.

The melting point (Tm) of the resin that forms the shell layer is preferably 100° C. or higher and 150° C. or lower. When an image is formed using a toner including toner particles having shell layers composed of a resin having an excessively high melting point, it may be difficult to properly fix the toner at low temperatures. When the shell layer is formed using a resin having an excessively low melting point, the heat-resistant storage stability of the toner may be impaired. The melting point of the resin that forms the shell layer can be measured with a differential scanning calorimeter (DSC).

The glass transition point (Tg) of the resin that forms the shell layer is preferably 50° C. or higher and 70° C. or lower. By forming the shell layer from a resin having Tg in the above-described range, a toner including toner particles with excellent low-temperature fixability that are hardly crushed even when placed under stress is easily obtained. The glass transition point of the resin that forms the shell layer can be measured by a method similar to the above-described method for measuring the glass transition point of a binder resin.

The number-average molecular mass (Mn) of the resin that forms the shell layer is preferably 3,000 or higher and 30,000 or lower. The mass-average molecular mass (Mw) of the resin that forms the shell layer is preferably 10,000 or higher and 100,000 or lower. The number-average molecular mass (Mn) and the mass-average molecular mass (Mw) of the resin that forms the shell layer can be measured by using gel permeation chromatography.

The mass of the shell layer is preferably 7 parts by mass or more and 20 parts by mass or less based on 100 parts by mass of the binder resin contained in toner core particles.

Ethylene-Unsaturated Carboxylic Acid Copolymer

The ethylene-unsaturated carboxylic acid copolymer is present at the interface between the toner core particle and the shell layer. The content of units derived from the unsaturated carboxylic acid of the ethylene-unsaturated carboxylic acid copolymer is preferably 6% by mass or more and 20% by mass or less because a toner including toner particles with excellent storage stability that are hardly crushed even when placed under mechanical stress for a long period of time is easily obtained.

The ethylene-unsaturated carboxylic acid copolymer has excellent affinity with various resins. The ethylene-unsaturated carboxylic acid copolymer has a carboxyl group. Therefore, in the toner according to the first embodiment, the carboxyl group in the ethylene-unsaturated carboxylic acid copolymer can form a hydrogen bond with a carboxyl group contained in the polyester resin contained in the binder resin, and a carbonyl group contained in the (meth)acrylic resin and/or the styrene-(meth)acrylic resin contained in the shell layer.

When a hydrogen bond is formed between the ethylene-unsaturated carboxylic acid copolymer and the shell layer, the ethylene-unsaturated carboxylic acid copolymer comes properly into close contact with both the shell layer and the toner core particle, so that the bond between the shell layer and the toner core particle is strengthened. Consequently, the strength of the toner particles is enhanced. Therefore, the toner particles in the toner according to the first embodiment, in which an ethylene-unsaturated carboxylic acid copolymer is present between the toner core particles and the shell layers, are hardly crushed even when placed under stress for a long period of time in a developing unit.

The melt flow rate of the ethylene-unsaturated carboxylic acid copolymer as measured at 190° C. under a load of 2.16 kg is preferably 35 g/10 minutes or higher and 500 g/10 minutes or lower. In the toner including toner particles containing an ethylene-unsaturated carboxylic acid copolymer having a melt flow rate in the above-described range, the ethylene-unsaturated carboxylic acid copolymer existing at the interface between the toner core particle and the shell layer tends to soften and flow when the toner is heated. In the case where an image is formed using the toner according to the first embodiment based on the thermal property of the ethylene-unsaturated carboxylic acid copolymer described above, when the toner is heated at the time of fixation, the ethylene-unsaturated carboxylic acid copolymer softens and flows, so that the bond between the shell layer and the toner core particle is weakened. Therefore, by using an ethylene-unsaturated carboxylic acid copolymer having a melt flow rate of 35 g/10 minutes or higher and 500 g/10 minutes or lower as measured at 190° C. under a load of 2.16 kg, a toner, which has proper low-temperature fixability to a recording medium as the shell layer is easily ruptured during heating when toner is fixed onto the recording medium can be obtained. The ethylene-unsaturated carboxylic acid copolymer is described in detail below.

The ethylene-unsaturated carboxylic acid copolymer is a resin obtained by copolymerizing monomers including at least ethylene and an unsaturated carboxylic acid. The ethylene-unsaturated carboxylic acid copolymer may be used in a combination of two or more.

Examples of unsaturated carboxylic acids for use in preparation of the ethylene-unsaturated carboxylic acid copolymer include acrylic acid, methacrylic acid, ethacrylic acid, maleic acid, fumaric acid, itaconic acid, maleic anhydride, itaconic anhydride, monomethyl maleate and monoethyl maleate. These unsaturated carboxylic acids may be used in a combination of two or more. Of these, (meth)acrylic acid is preferable because it is excellent in polymerization reactivity with an ethylene monomer.

The ethylene-unsaturated carboxylic acid copolymer may be a copolymer of ethylene and unsaturated carboxylic acid and a monomer other than ethylene and unsaturated carboxylic acid. Examples of the monomer other than ethylene and unsaturated carboxylic acid include vinyl esters such as vinyl acetate and vinyl propionate; and unsaturated carboxylic acid esters such as methyl acrylate, ethyl acrylate, isopropyl acrylate, isobutyl acrylate, n-butyl acrylate, isooctyl acrylate, acrylic acid-2-ethylhexyl, methyl methacrylate, ethyl methacrylate, isobutyl methacrylate, dimethyl maleate and diethyl maleate.

The sum of the content of units derived from ethylene and the content of units derived from unsaturated carboxylic acid that are contained in the ethylene-unsaturated carboxylic acid copolymer is preferably 70 mol % or more, more preferably 80 mol % or more, especially preferably 90 mol % or more, and most preferably 100 mol %, of all the units that form the ethylene-unsaturated carboxylic acid copolymer. In the ethylene-unsaturated carboxylic acid copolymer, the content of units derived from unsaturated carboxylic acid in the ethylene-unsaturated carboxylic acid copolymer is 6% by mass or more and 20% by mass or less.

The melting point of the ethylene-unsaturated carboxylic acid copolymer is preferably 85° C. or higher and 105° C. or lower. When an image is formed using a toner including toner particles prepared by using an ethylene-unsaturated carboxylic acid copolymer having an excessively high melting point, it may be difficult to properly fix the toner at low temperatures. A toner including toner particles prepared by using an ethylene-unsaturated carboxylic acid copolymer having an excessively low melting point may be inferior in the heat-resistant storage stability. The melting point of the ethylene-unsaturated carboxylic acid copolymer can be measured in accordance with ISO K7121:1987.

The melt flow rate (MFR) of the ethylene-unsaturated carboxylic acid copolymer is preferably 30 g/10 minutes or higher, more preferably 100 g/10 minutes or higher and 500 g/10 minutes or lower. When an image is formed using a toner including toner particles prepared by using an ethylene-unsaturated carboxylic acid copolymer having a melt flow rate in the range of 30 g/10 minutes or more, the toner can be properly fixed even at a low fixing temperature below 120 degrees. When an image is formed using a toner including toner particles prepared by using an ethylene-unsaturated carboxylic acid copolymer having a melt flow rate in the range of 100 g/10 minutes or higher and 500 g/10 minutes or lower, the toner can be properly fixed even at a fixing temperature of 110° C. or lower. When an image is formed using a toner including toner particles prepared by using an ethylene-unsaturated carboxylic acid copolymer having an excessively low melt flow rate, the ethylene-unsaturated carboxylic acid copolymer is difficult to soften and melt, so that it is difficult to broke the shell even when the toner is heated during fixation. Therefore, it may be difficult to properly fix the toner at low temperatures. The toner including toner particles prepared by using an ethylene-unsaturated carboxylic acid copolymer having an excessively high melt flow rate may be inferior in the heat-resistant storage stability. The melt flow rate can be measured in accordance with JIS K7210: 1999 (190° C., load 2.16 kg) by using a melt indexer (G-01 (manufactured by Toyo Seiki Seisaku-Sho, Ltd.)).

For the thermoplastic resin, the melt flow rate is generally known to give an indication of the molecular mass. For the ethylene-unsaturated carboxylic acid copolymer, the melt flow rate also can be adjusted by appropriately changing production conditions to adjust its molecular mass by a known method.

External Additive

The toner particles in the toner according to the first embodiment may be surface-treated with an external additive as required. The external additive may be appropriately selected from external additives used for toners heretofore. Specific examples of the preferred external additive include silica and metal oxides such as alumina, titanium oxide, magnesium oxide, zinc oxide, strontium titanate and barium titanate. These external additives may be used in a combination of two or more. These external additives may be hydrophobized by using a hydrophobing agent such as an aminosilane coupling agent or silicone oil. When a hydrophobized external additive is used, reduction of the charge of the toner particles at high temperature and high humidity is easily suppressed, and a toner including toner particles with excellent flowability is easily obtained.

Typically, the particle diameter of the external additive is preferably 0.01 μm or larger and 1.0 μm or smaller.

Typically, the amount of the external additive used is preferably 0.1 parts by mass or more and 10 parts by mass or less, and more preferably 0.2 parts by mass or more and 5 parts by mass or less based on 100 parts by mass of toner particles (toner base particles) before external addition treatment.

Carrier

The toner may be mixed with a desired carrier and used as a two-component developer. When the two-component developer is prepared, a magnetic carrier is preferably used.

Examples of the preferred carrier include those whose carrier core material is coated with a resin. Specific examples of the carrier core material include particles such as those of iron, oxidized iron, reduced iron, magnetite, copper, silicon steel, ferrite, nickel and cobalt; particles of alloys of the above-mentioned materials and metals such as manganese, zinc and aluminum; particles of iron-nickel alloys and iron-cobalt alloys; particles of ceramics such as titanium oxide, aluminum oxide, copper oxide, magnesium oxide, lead oxide, zirconium oxide, silicon carbide, magnesium titanate, barium titanate, lithium titanate, lead titanate, lead zirconate and lithium niobate; particles of higher-permittivity materials such as ammonium dihydrogen phosphate, potassium dihydrogen phosphate and Rochelle salts; and resin carriers with the above-mentioned magnetic particles dispersed in resins.

Specific examples of the resin with which the carrier core material is coated include (meth)acrylic polymers, styrene polymers, styrene-(meth)acrylic copolymers, olefin polymers (polyethylene, chlorinated polyethylene and polypropylene), polyvinyl chloride, polyvinyl acetate, polycarbonate, cellulose resins, polyester resins, unsaturated polyester resins, polyamide resins, polyurethane resins, epoxy resins, silicone resins, fluorine resins (polytetrafluoroethylene, polychlorotrifluoroethylene, and polyvinylidene fluoride), phenol resins, xylene resins, diallyl phthalate resins, polyacetal resins and amino resins. These resins may be used in a combination of two or more.

Particle diameter of the carrier is preferably 20 μm or larger and 120 μm or smaller and more preferably 25 μm or larger and 80 μm or smaller as a particle diameter measured by an electron microscope.

When the toner for electrostatic latent-image development of the present disclosure is used as the two-component developer, the content of the toner is preferably 3% by mass or more and 20% by mass or less and more preferably 5% by mass or more and 15% by mass or less based on the mass of the two-component developer. By forming an image by using a two-component developer containing a toner in an amount in the above-described range, images having an appropriate image density can be formed continuously, and scattering of the toner particles from the developing unit is suppressed, so that contamination of the inside of the image-forming apparatus and adherence of the toner on a recording medium such as a transfer sheet can be suppressed.

The toner for electrostatic latent-image development according to the first embodiment of the present disclosure as explained above has excellent storage stability and low-temperature fixability, and toner particles in the toner are inhibited from being crushed as a result of long-term stress. Therefore, the toner for electrostatic latent-image development according to the first embodiment is suitably used in various image-forming apparatuses.

The method for producing the toner (toner particles) according to the first embodiment is not particularly limited, but the preferred production method is exemplified by a method for producing a toner for electrostatic latent-image development according to the second embodiment as explained below. The method for producing a toner for electrostatic latent-image development according to the second embodiment is explained in detail below.

Second Embodiment

The method for producing a toner for electrostatic latent-image development according to the second embodiment of the present disclosure includes:

steps (I) to (V):

(I): obtaining an aqueous dispersion (A) containing fine particles including a binder resin, followed by aggregation of the fine particles in the presence of an aggregating agent to obtain an aqueous dispersion (B) containing toner core particles;

(II): mixing the aqueous dispersion (B) with an aqueous dispersion (C) containing fine particles including an ethylene-unsaturated carboxylic acid copolymer to obtain an aqueous dispersion (D) containing the toner core particles and the fine particles of the ethylene-unsaturated carboxylic acid copolymer;

(III): heating the aqueous dispersion (D) to obtain an aqueous dispersion (E) containing toner core particles with the fine particles of the ethylene-unsaturated carboxylic acid copolymer attached on the surface;

(IV): mixing the aqueous dispersion (E) with an aqueous dispersion (F) containing resin fine particles composed of a resin including a (meth)acrylic resin and/or a styrene-(meth)acrylic resin to obtain an aqueous dispersion (G) containing toner core particles with the fine particles of the ethylene-unsaturated carboxylic acid copolymer attached on the surface, and the resin fine particles; and (V): obtaining toner particles by heating the aqueous dispersion (G) to form shell layers on the surfaces of the toner core particles.

The method for producing a toner for electrostatic latent-image development according to the second embodiment may include, in addition to the above-described steps (I) to (V), the following steps (VI) to (VIII) as required.

(VI): A cleaning step of cleaning the toner particles.

(VII): A drying step of drying the toner particles.

(VIII): An external addition step of attaching an external additive on the surfaces of toner particles (toner base particles).

Steps (I) to (VIII) are explained in order below.

(I) Step of Obtaining Aqueous Dispersion (B) Containing Toner Core Particles

In step (I), an aqueous dispersion (A) containing fine particles including a binder resin is obtained, followed by aggregation of the fine particles in the presence of an aggregating agent to obtain an aqueous dispersion (B) containing toner core particles A method for preparation of the aqueous dispersion (A) containing fine particles including a binder resin and a method for aggregating fine particles are explained below.

Method for Preparation of Aqueous Dispersion (A) Containing Fine Particles Including Binder Resin The method for preparation of the aqueous dispersion (A) containing fine particles including a binder resin is not particularly limited. The fine particles including a binder resin may be either fine particles of a binder resin or fine particles of a binder resin composition containing a binder resin and optional components such as a colorant, a release agent and a charge control agent. Normally, the fine particles including a binder resin are prepared in the form of an aqueous dispersion containing fine particles by forming a binder resin or a composition that contains a binder resin and optional components such as a colorant, a release agent and a charge control agent, into fine particles having a desired size in an aqueous medium.

The aqueous dispersion (A) containing fine particles including a binder resin may contain fine particles other than the fine particles including a binder resin. Examples of the fine particles other than the fine particles including a binder resin include fine particles of a colorant, fine particles of a release agent, and fine particles composed of a colorant and a release agent. A method for preparation of fine particles including a binder resin, a method for preparation of fine particles of a release agent and a method for preparation of fine particles of a colorant are explained in order below. Fine particles including components different from those of the fine particles explained here can be prepared by a method that is appropriately selected from methods for producing these particles.

Preparation of Fine Particles Including Binder Resin

First, a binder resin is coarsely pulverized to preferably 30 μm or smaller with a pulverizing device such as a cutter mill, a feather mill or a jet mill. The coarsely pulverized product is dispersed in an aqueous medium such as ion-exchanged water to obtain a dispersion. The dispersion is heated to a temperature at least 10° C. above the softening point of the binder resin as measured by a flow tester (a temperature of at most about 200° C.). A strong shear force is applied to the dispersion containing the heated binder resin by using a homogenizer or a pressure-discharge type disperser to obtain an aqueous dispersion containing fine particles including a binder resin.

When the fine particles including a binder resin are fine particles of a binder resin composition containing a binder resin and optional components such as a colorant, a release agent and a charge control agent, first the binder resin and the optional components such as a colorant, a release agent and a charge control agent are mixed in a mixer such as a HENSCHEL MIXER (manufactured by Mitsui Mining Co., Ltd.). Then the mixture obtained is melted and kneaded with a kneading device such as a twin-screw extruder, a three-roll kneader or a two-roll kneader to obtain a binder resin composition. The binder resin composition obtained is cooled, and the binder resin composition is then coarsely pulverized to preferably 30 lam or smaller with a pulverizing device such as a cutter mill, a feather mill or a jet mill. The coarsely pulverized product obtained from the binder resin composition is dispersed in an aqueous medium to obtain a dispersion and the dispersion containing the binder resin composition is heated to a temperature at least 10° C. above the softening point of the binder resin as measured by a flow tester. A strong shear force is applied to the dispersion containing the heated binder resin composition by using a homogenizer or a pressure-discharge type disperser to obtain an aqueous dispersion containing binder resin composition fine particles.

Examples of the device to apply a strong shear force to the dispersion include the NANO3000 (manufactured by BeRyu Co., Ltd.), NANOMIZER (manufactured by Yoshida Kikai CO., LTD.), MICROFLUIDIZER (manufactured by MFI Corporation), GAULIN homogenizer (manufactured by Manton-Gaulin Co., Ltd.) and CLEARMIX W-Motion (manufactured by M Technique Co., Ltd.).

The aqueous medium may be a liquid medium having water as a principal component, and may be appropriately selected from water such as tap water, industrial water, distilled water and ion-exchanged water.

The aqueous medium may contain an organic solvent. When the aqueous medium contains an organic solvent, the amount of the organic solvent is preferably 20% by mass or less, preferably 10% by mass or less, preferably 5% by mass or less based on the mass of the aqueous medium. Examples of the organic solvent that may be contained in the aqueous medium include alcohols such as ethanol and methanol; ethers such as tetrahydrofuran; ketones such as acetone; and nitrogen-containing polar organic solvents such as N,N-dimethylformamide, N,N-dimethylacetamide and N-methyl-2-pyrrolidone.

It is preferred to add a surfactant to the aqueous medium. By adding a surfactant to the aqueous medium, transformation of a binder resin composition that contains a binder resin to fine particles can be made to proceed properly. Therefore, when a surfactant is added to the aqueous medium, an aqueous dispersion containing fine particles with excellent dispersion stability is easily obtained.

The amount of the aqueous medium used, based on the amount of the coarsely pulverized product, is not particularly limited as long as transformation of the coarsely pulverized product to fine particles proceeds properly. The amount of the aqueous medium used, based on the binder resin composition containing a binder resin, varies with the type of device used for preparation of fine particles, but typically the amount is preferably 1 time by mass or more and 5 times by mass or less, more preferably 2 times by mass or more and 4 times by mass or less, based on the mass of the coarsely pulverized product.

The surfactant that can be used for preparation of fine particles in the aqueous medium is not particularly limited, and may be appropriately selected from the group consisting of anionic surfactants, cationic surfactants and nonionic surfactants. Examples of the anionic surfactant include sulfuric acid ester salt type surfactants, sulfonic acid salt type surfactants and soaps. Examples of the cationic surfactant include amine salt type surfactants and quaternary ammonium salt type surfactants. Examples of the nonionic surfactant include polyethylene glycol type surfactants, alkylphenol ethylene oxide adduct type surfactants, and polyhydric alcohol type surfactants, which are derivatives of polyhydric alcohols such as glycerin, sorbitol and sorbitan. Among these surfactants, it is preferred to use at least one of the anionic surfactant and the nonionic surfactant. These surfactants may be used alone or in a combination of two or more.

When a surfactant is used, the concentration of the surfactant in the aqueous medium is preferably 0.1% by mass or higher and 5.0% by mass or lower.

In the case where the binder resin is a resin having an acidic group, the pH of the aqueous medium may be reduced to about 3 to 4 (inclusively) under the influence of the acidic group exposed at the surfaces of fine particles as the specific surface area of the binder resin is increased when the binder resin is directly formed into fine particles in the aqueous medium. In this case, a polyester resin as the binder resin may be hydrolyzed, or it may be difficult to reduce the particle diameter of the obtained fine particles to the desired particle diameter.

To suppress the above-described problem, it is preferred to add a basic substance to the aqueous medium when fine particles including a binder resin are prepared. Preferred examples of the basic substance include alkali-metal hydroxides such as sodium hydroxide, potassium hydroxide and lithium hydroxide; alkali-metal carbonates such as sodium carbonate and potassium carbonate; alkali-metal hydrogen carbonates such as sodium hydrogen carbonate and potassium hydrogen carbonate; and nitrogen-containing organic bases such as N,N-dimethyl ethanolamine, N,N-diethyl ethanolamine, triethanolamine, tripropanolamine, tributanolamine, triethylamine, n-propylamine, n-butylamine, isopropylamine, monomethanolamine, morpholine, methoxy propylamine, pyridine and vinylpyridine.

An aqueous dispersion containing fine particles including a binder resin or a binder resin composition can also be prepared by dissolving in an appropriate solvent a binder resin or binder resin composition prepared by the above-described method, followed by dispersion and emulsification of the resulting solution in an aqueous medium containing a surfactant by using an emulsifying device such as a homogenizer, and then performing solvent-removal treatment.

Fine particles including a binder resin can also be prepared by the so-called phase-transfer emulsification method. Specifically, fine particles including a binder resin are obtained by the following method.

First, a binder resin or binder resin composition obtained by the above-described method is dissolved in an appropriate solvent, followed by adding a basic substance to the resulting solution to perform neutralization treatment. Water is added to the neutralized solution to effect phase transformation, and the solvent is then removed while the solution is heated and stirred, whereby an aqueous dispersion containing fine particles including a binder resin or a binder resin composition can be prepared.

The volume-average particle diameter ($D_{50}$) of fine particles including a binder resin or a binder resin composition prepared by the above-described method is preferably 1 μm or smaller, more preferably 0.1 μm or larger and 0.5 μm or smaller. When fine particles including a binder resin or a binder resin composition, with the volume-average particle diameter ($D_{50}$) falling within the above-mentioned range, are used, a toner including toner particles having a uniform shape and a sharp particle-diameter distribution is easily prepared. By doing so, the performance and productivity of the toner can be stabilized. The volume-average particle diameter ($D_{50}$) of fine particles can be measured with a laser diffraction-type particle-size distribution measuring device (SALD 2200 (manufactured by Shimadzu Corporation)).

The method for preparation of fine particles including a binder resin has been explained as described above, and fine particles including a binder resin, fine particles including a binder resin and a release agent and fine particles including a binder resin, a colorant and a release agent can also be prepared in the same manner as in the above-described method except that the components compounded with the binder resin are changed.

Preparation of Fine Particles Including Release Agent

The release agent is coarsely pulverized to about 100 μm or less beforehand. The coarsely pulverized product of the release agent is added into an aqueous medium containing a surfactant to obtain a slurry. The slurry obtained is heated to a temperature equal to or higher than the melting point of the release agent. For preparation of fine particles including a release agent, a surfactant similar to the surfactant used for preparation of fine particles including a binder may be used. A strong shear force is applied to the heated slurry by using a homogenizer or a pressure-discharge type disperser to prepare an aqueous dispersion containing fine particles including a release agent.

Examples of the device to apply a strong shear force to the aqueous dispersion include the NANO3000 (manufactured by BeRyu Co., Ltd.), NANOMIZER (manufactured by Yoshida Kikai CO., LTD.), MICROFLUIDIZER (manufactured by MFI Corporation), GAULIN homogenizer (manufactured by Manton-Gaulin Co., Ltd.) and CLEARMIX W-Motion (manufactured by M Technique Co., Ltd.).

Normally the melting point of the release agent is often 100° C. or lower. In this case, the release agent can be formed into fine particles by using a device capable of applying a strong shear force to the slurry containing a release agent while the slurry is heated to its melting point of the release agent or higher at atmospheric pressure. When the melting point of the release agent is above 100° C., the release agent can be formed into fine particles by forming fine particles with a pressure-proof device.

The volume-average particle diameter ($D_{50}$) of fine particles contained in the aqueous dispersion containing fine particles including a release agent is preferably 1 μm or smaller, more preferably 0.1 μm or larger and 0.3 μm or smaller. The volume-average particle diameter ($D_{50}$) of fine particles can be measured by using a laser diffraction type particle-size distribution measuring device (SALD 2200 (manufactured by Shimadzu Corporation)).

Preparation of Fine Particles Including Colorant

A colorant is dispersed together with an additive for the colorant, such as a surfactant as required in an aqueous medium containing a surfactant by using a known disperser, thereby producing fine particles including a colorant. As the surfactant, any of an anionic surfactant, a cationic surfactant and a nonionic surfactant may be used. The amount of surfactant used is preferably equal to or greater than the critical micelle concentration (CMC).

Examples of the disperser used to disperse the colorant include pressure-type dispersers such as an ultrasonic disperser, a mechanical homogenizer, a MANTON GAULIN homogenizer and a pressure-type homogenizer, as well as medium-type dispersers such as a sand grinder, a Gettman mill and a diamond fine mill.

When the fine particles are fine particles including a colorant, the volume-average particle diameter ($D_{50}$) thereof is 0.05 μm or larger and 0.2 μm or smaller.

Method for Aggregation of Fine Particles

Fine particles prepared by the above-described method are appropriately combined so that predetermined components are included in the toner core particles, thereby forming the toner core particles as aggregated particles. Examples of the preferred method for aggregating fine particles include a method in which an aggregating agent is added to an aqueous dispersion containing fine particles.

Examples of the aggregating agent include inorganic metal salts, inorganic ammonium salts and divalent or higher-valent metal complexes. Examples of the inorganic metal salt include metal salts such as sodium sulfate, sodium chloride, calcium chloride, calcium nitrate, barium chloride, magnesium chloride, zinc chloride, aluminum chloride and aluminum sulfate; and inorganic metal salt polymers such as polyaluminum chloride and polyaluminum hydroxide. Examples of the inorganic ammonium salt include ammonium sulfate, ammonium chloride and ammonium nitrate. Cationic surfactants of the quaternary ammonium salt type and polyethylenimines may also be used as the aggregating agent.

Divalent metal salts and monovalent metal salts are suitably used as the aggregating agent. Preferably, a divalent metal salt and a monovalent metal salt are used in combination. The divalent metal salt and the monovalent metal salt impart different aggregation rates to fine particles. Therefore, when these metal salts are used in combination, the particle-size distribution of toner core particles is easily made sharp, while the particle diameter of the toner core particles obtained is controlled to a diameter in the desired range.

The amount of the aggregating agent added is preferably 0.1 mmol/g or more and 10 mmol/g or less, based on the solid content of the aqueous dispersion containing fine particles. Preferably, the amount of the aggregating agent added is appropriately adjusted according to the type and amount of surfactant contained in the aqueous dispersion containing fine particles.

Conditions for adding the aggregating agent are not particularly limited as long as aggregation of fine particles proceeds properly. Preferably, the aggregating agent is added at a temperature equal to or below the glass transition point of the binder resin after the pH of the aqueous dispersion containing fine particles is adjusted. The toner according to the first embodiment includes a polyester resin as the binder resin. Therefore, the aggregating agent is preferably added after the pH of the aqueous dispersion containing fine particles is adjusted to the alkali side, preferably to a pH of 10 or higher. By doing so, fine particles can be uniformly aggregated, and the particle-diameter distribution of toner core particles can be made sharp. The aggregating agent may be added all at once or sequentially.

Preferably, an aggregation-terminating agent is added after aggregation proceeds until the particle diameter of toner core particles as aggregated particles becomes the desired diameter. Examples of the aggregation-terminating agent include sodium chloride and sodium hydroxide. In this way, an aqueous dispersion (B) containing toner core particles is obtained.

(II) Step of Obtaining Aqueous Dispersion (D) Containing Toner Core Particles and Fine Particles of Ethylene-Unsaturated Carboxylic Acid Copolymer In step (II), the aqueous dispersion (B) obtained in step (I) is mixed with an aqueous dispersion (C) containing fine particles of an ethylene-unsaturated carboxylic acid copolymer to obtain an aqueous dispersion (D) containing the toner core particles and the fine particles of the ethylene-unsaturated carboxylic acid copolymer. A preferred method for preparation of the aqueous dispersion (C) containing fine particles including an ethylene-unsaturated carboxylic acid copolymer is described below.

Preparation of Aqueous Dispersion (C) Containing Fine Particles Including Ethylene-Unsaturated Carboxylic Acid Copolymer The aqueous dispersion (C) containing fine particles including an ethylene-unsaturated carboxylic acid copolymer is obtained by stirring/mixing an aqueous medium, a pulverized product of the ethylene-unsaturated carboxylic acid copolymer, a neutralizer and an organic solvent under heating in a tightly closable reaction vessel equipped with a stirrer, a thermometer and a heater.

When two or more ethylene-unsaturated carboxylic acid copolymers are used, a mixture of pulverized products of two or more different ethylene-unsaturated carboxylic acid copolymers may be used as the pulverized product, or a pulverized product obtained by using a melted/kneaded product obtained by melting/kneading with a kneading device two or more different ethylene-unsaturated carboxylic acid copolymers may be used.

The neutralizer is used for preparation of the aqueous dispersion (C) containing fine particles including an ethylene-unsaturated carboxylic acid copolymer to neutralize a carboxyl group of the ethylene-unsaturated carboxylic acid copolymer. Examples of the neutralizer include alkali-metal compounds such as sodium hydroxide and potassium hydroxide; and organic amine compounds such as ammonia, dimethylamine, trimethylamine, monoethylamine, diethylamine, triethylamine, N,N-dimethyl ethanolamine, aminoethanolamine, N-methyl-N,N-diethanolamine, isopropylamine, imino-bis-propylamine, 3-ethoxypropylamine, 3-diethylaminopropylamine, sec-butylamine, propylamine, methylaminopropylamine, 3-methoxypropylamine, monomethanolamine, morpholine, N-methylmorpholine and N-ethylmorpholine. Of these, it is preferred to use diethylamine or triethylamine as the neutralizer. The neutralizers may be used alone or in a combination of two or more.

The boiling point of the neutralizer used to prepare the aqueous dispersion (C) is preferably 0° C. or higher and 250°

C. or lower. When the boiling point is too low, fine particles including an ethylene-unsaturated carboxylic acid copolymer may not be properly dispersed in the aqueous medium because the neutralizer tends to be volatilized from the aqueous dispersion (C). On the other hand, when the boiling point of the neutralizer is too high, neutralizer tends to remain in the toner particles. If neutralizer remains in the toner particles, the heat-resistant storage stability of the toner including the toner particles may be impaired.

Typically, the amount of the neutralizer used for preparation of the aqueous dispersion (C) is preferably 0.5 molar equivalents or more and 15 molar equivalents or less, more preferably 0.8 molar equivalents or more and 3.0 molar equivalents or less, especially preferably 1.0 molar equivalent or more and 2.5 molar equivalents or less based on the molar fraction of carboxyl groups of the ethylene-unsaturated carboxylic acid copolymer.

When an organic amine compound and/or ammonia is used as the neutralizer, the organic amine compound and/or ammonia can be partially distilled away from the aqueous dispersion (C) by subjecting to solvent-removal treatment the aqueous dispersion (C) containing fine particles including an ethylene-unsaturated carboxylic acid copolymer. In this case, the amount of the organic amine compound and/or ammonia allowed to remain in the aqueous dispersion (C) is preferably 0.5 molar equivalents or more based on the molar fraction of carboxyl groups of the ethylene-unsaturated carboxylic acid copolymer. By using the aqueous dispersion (C) prepared in this way, a toner including toner particles having proper heat-resistant storage stability can be obtained. The content of the organic amine compound and/or ammonia in the toner particles can be quantitatively determined by gas chromatography.

The organic solvent that is used for preparation of the aqueous dispersion (C) containing fine particles including an ethylene-unsaturated carboxylic acid copolymer is used to improve the dispersibility of fine particles of the ethylene-unsaturated carboxylic acid copolymer. Specific examples of organic solvents include alcohols such as methanol, ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol and cyclohexanol; ketones such as methyl ethyl ketone, methyl isobutyl ketone, ethyl butyl ketone, cyclohexanone and isophorone; ethers such as tetrahydrofuran and dioxane; esters such as ethyl acetate, n-propyl acetate, isopropyl acetate, n-butyl acetate, isobutyl acetate, sec-butyl acetate, 3-methoxybutyl acetate, methyl propionate, ethyl propionate, diethyl carbonate and dimethyl carbonate; glycols or glycol derivatives such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monobutyl ether, diethylene glycol ethyl ether acetate, propylene glycol, propylene glycol monomethyl ether, propylene glycol monobutyl ether and propylene glycol methyl ether acetate; 3-methoxy-3-methylbutanol; 3-methoxybutanol; acetonitrile; dimethylformamide; dimethylacetamide; diacetone alcohol; and ethyl acetoacetate. Of these, it is preferred to use at least one selected from methanol, ethanol, n-propanol and isopropanol as the organic solvent because these organic solvents are easily removed from the aqueous dispersion (C). The organic solvents may be used in a combination of two or more.

The solubility in water at 20° C. of the organic solvent used for preparation of the aqueous dispersion (C) is preferably 50 g/L or higher, more preferably 100 g/L or higher. The boiling point of the organic solvent is preferably 30° C. or higher and 250° C. or lower, more preferably 50° C. or higher and 200° C. or lower.

By using an organic solvent having the physical properties described above, fine particles including an ethylene-unsaturated carboxylic acid copolymer can be properly dispersed in the aqueous medium. When the aqueous dispersion (C) is prepared with an organic solvent having an excessive low solubility in water at 20° C., it may be difficult to properly disperse in the aqueous medium fine particles including an ethylene-unsaturated carboxylic acid copolymer.

When the aqueous dispersion (C) is prepared by using an organic solvent having an excessively low boiling point, fine particles including an ethylene-unsaturated carboxylic acid copolymer may not be properly dispersed in the aqueous medium because the organic solvent tends to volatilize from the aqueous dispersion (C). When the toner is prepared by using the aqueous medium (C) prepared with an organic solvent having an excessively high boiling point, the heat-resistant storage stability of the toner may be impaired because the organic solvent tends to remain in the toner obtained.

The molecular mass of the organic solvent that is used for preparation of the aqueous dispersion (C) is preferably 90 or less. When the aqueous dispersion (C) is prepared with an organic solvent having an excessively large molecular mass, fine particles including an ethylene-unsaturated carboxylic acid copolymer may not be properly dispersed in the aqueous medium.

The amount of organic solvent used for preparation of the aqueous dispersion (C) is preferably 5% by mass or more and 50% by mass or less based on referred to the mass of the ethylene-unsaturated carboxylic acid copolymer.

A specific example of a method for preparation of the aqueous dispersion (C) containing fine particles including an ethylene-unsaturated carboxylic acid copolymer is explained below.

First, a pulverized product of the ethylene-unsaturated carboxylic acid copolymer, a neutralizer and an organic solvent are added to an aqueous medium put in a reaction vessel, and the reaction vessel is tightly sealed. Thereafter, the contents are stirred/mixed while the inside of the reaction vessel is kept at a temperature of 40° C. or lower. Then the internal temperature of the reaction vessel is increased to a temperature in a range of 120° C. or higher and 180° C. or lower while stirring is continued. When the elevated temperature is too low, it is difficult to properly disperse fine particles including an ethylene-unsaturated carboxylic acid copolymer in the aqueous medium. On the other hand, when the elevated temperature is too high, the molecular mass of the ethylene-unsaturated carboxylic acid copolymer may be reduced. Stirring is continued at the elevated temperature for preferably 60 minutes or more, followed by lowering of the internal temperature of the reaction vessel to normal temperature. The time taken to decrease the temperature from 120° C. to 80° C. is preferably 30 minutes or more, more preferably 60 minutes or more. If the time taken to decrease the temperature from 120° C. to 80° C. is too short, the particle diameter of fine particles of the ethylene-unsaturated carboxylic acid may be larger than the desired particle diameter.

After the internal temperature of the reaction vessel reaches normal temperature, the contents of the reaction vessel are filtered to obtain the aqueous dispersion (C) containing fine particles of the ethylene-unsaturated carboxylic acid copolymer. The particle diameter of fine particles including an ethylene-unsaturated carboxylic acid copolymer that are obtained in this way is preferably 0.2 μm or less, more preferably 0.1 μm or less.

The reaction vessel used for preparation of the aqueous dispersion (C) containing fine particles including an ethylene-unsaturated carboxylic acid copolymer may be a reaction vessel equipped with a known solid/liquid stirrer and an emulsifying device, as long as fine particles including an ethylene-unsaturated carboxylic acid copolymer can be properly dispersed in the aqueous medium. The reaction vessel that is used for preparation of the aqueous dispersion (C) is preferably a tightly closable container having a pressure resistance of 0.1 MPa (G) or more.

(III) Step of Obtaining Aqueous Dispersion (E) Containing Toner Core Particles with Fine Particles of Ethylene-Unsaturated Carboxylic Acid Copolymer Attached on the Surface In step (III), the aqueous dispersion (D) obtained in step (II) is heated to obtain an aqueous dispersion (E) containing toner core particles with fine particles of the ethylene-unsaturated carboxylic acid copolymer attached on the surface. The temperature for heating the aqueous dispersion (D) is preferably 40° C. or higher and 90° C. or lower. By heating the aqueous dispersion (D) at a temperature in the above-described range, fine particles of the ethylene-unsaturated carboxylic acid copolymer can be uniformly attached on the surfaces of toner core particles.

Step of Obtaining Aqueous Dispersion (G) Containing Toner Core Particles with Fine Particles of Ethylene-Unsaturated Carboxylic Acid Copolymer Attached on the Surface, and Resin Fine Particles In step (IV), the aqueous dispersion (E) obtained in step (III) is mixed with an aqueous dispersion (F) containing resin fine particles composed of a resin including a (meth)acrylic resin, and/or a styrene-(meth)acrylic resin, for forming shell layers, to obtain an aqueous dispersion (G) containing toner core particles with fine particles of the ethylene-unsaturated carboxylic acid copolymer attached on the surface, and the resin fine particles.

The volume-average particle diameter of resin fine particles is preferably 0.03 μm or larger and 0.50 μm or smaller, more preferably 0.05 μm or larger and 0.30 μm or smaller. When the volume-average particle diameter of the resin fine particles with which the toner core particles are coated falls within the above-described range, the toner core particles are easily uniformly coated with resin fine particles. The volume-average particle diameter of resin fine particles, with which toner core particles are coated, can be measured with an electrophoresis light-scattering photometer (e.g. LA-950 V2 (manufactured by Horiba, Ltd.)).

Preferably, before the aqueous dispersion (E) is mixed with the aqueous dispersion (F), the pH of the aqueous dispersion (F) is adjusted to about 8 by adding a basic substance to the aqueous dispersion (F) to stabilize the dispersion state of fine particles in the dispersion.

(V) Step of Forming Shell Layers on Surfaces of Toner Core Particles

In step (V), the aqueous dispersion (G) obtained in step (IV) is heated to form shell layers on the surfaces of toner core particles with fine particles of the ethylene-unsaturated carboxylic acid copolymer attached thereon, thereby producing an aqueous dispersion of toner base particles. For forming shell layers on the surfaces of toner core particles, it is preferred that first, by adding an aggregating agent to the aqueous dispersion (G), resin fine particles are aggregated on the surfaces of toner core particles so that the ethylene-unsaturated carboxylic acid copolymer is present between the resin fine particle layer for forming shell layer and the toner core particle, thereby forming resin fine particle layers. Examples of the aggregating agent include magnesium chloride, calcium chloride and magnesium sulfate. Preferably, an aggregation-terminating agent is added to the aqueous dispersion (G) after coating of the surfaces of toner core particles with resin fine particles proceeds to a certain degree. Examples of the aggregation-terminating agent include sodium chloride and sodium hydroxide. According to above mentioned steps, aqueous dispersion (G) containing the toner base particles in which a toner core particle is coated with a shell layer can be obtained.

The temperature for heating the aqueous dispersion (G) containing toner core particles coated on the surface with resin fine particles is preferably no lower than the glass transition point (Tg) of the resin that forms resin fine particles and no higher than 90° C. By heating the aqueous dispersion (G) at a temperature within the above-described range, transformation of the resin fine particle layer, with which toner core particles are coated, to a film is made to proceed properly, so that toner core particles can be properly coated with shell layers.

Step (VI)

In cleaning step (VI), the toner base particles in the aqueous dispersion (G) obtained in step (V) are cleaned with water as required. Examples of the cleaning method include a method in which an aqueous dispersion (G) containing toner base particles is subjected to solid-liquid separation to collect toner base particles as a wet cake, and the wet cake obtained is cleaned with water, and a method in which toner base particles in an aqueous dispersion containing the toner base particles settle out, the supernatant is replaced with water and, after replacement, toner base particles are redispersed in water.

Step (VII)

The toner base particles in the aqueous dispersion (G) obtained in step (V) are dried through drying step (VII) as required. Examples of the preferred method for drying toner base particles include methods using a dryer such as a spray dryer, a fluidized-bed dryer, a vacuum-freeze dryer and a vacuum dryer. Among these methods, a method using a spray dryer is more preferable because agglomeration of toner base particles during drying is easily suppressed. When a spray dryer is used, an external additive can be attached on the surfaces of toner base particles by spraying a dispersion of an external additive such as silica together with the aqueous dispersion (G) containing toner base particles.

Step (VIII)

The toner particles (toner base particles) in the toner for electrostatic latent-image development, produced by the method of the present disclosure, may have an external additive attached on the surface as required. In step (VIII), toner core particles coated with shell layers are used as toner base particles, and an external additive is attached on the surfaces of toner base particles. Examples of the preferred method for attaching an external additive on the surfaces of toner base particles include a method in which a mixer such as a HENSCHEL MIXER or a NAUTA MIXER is used to mix toner base particles with an external additive while conditions are adjusted so that the external additive is not embedded into the surfaces of the toner base particles.

When the method for producing a toner for electrostatic latent-image development according to the second embodiment, which was explained above, is used, the toner particles in the toner according to the first embodiment can be easily prepared.

EXAMPLES

The present disclosure is explained more specifically with reference to examples below. In addition, the present disclosure is not limited to the examples.

Preparation Example 1

Preparation of Aqueous Dispersion Containing Colored Resin Fine Particles

An aqueous dispersion containing colored resin fine particles including a binder resin and a colorant was prepared by the following method.

The amorphous polyester resin shown below was used as a binder resin.

monomer composition: polyoxypropylene (2,2)-2,2-bis(4-hydroxyphenyl)propane/polyoxyethylene (2,0)-2,2-bis(4-hydroxyphenyl) propane/fumaric acid/trimellitic acid=25/25/46/4 (mole ratio)

number average molecular mass (Mn): 2,500 mass average molecular mass (Mw): 6,500 molecular mass distribution (Mw/Mn): 2.6 softening point (Tm): 91° C.

glass transition point (Tg): 51° C.

acid value: 15.5 mg KOH/g

In an FM Mixer (FM20C/I Model (manufactured by Nippon Coke & Engineering Co., Ltd.)), 1000 g of the binder resin and 50 g of the colorant (cyan pigment (copper phthalocyanine), C.I. Pig. Blue 15-3, (manufactured by Dainichiseika Color & Chemicals Mfg. Co., Ltd.)) were put, and mixed at a temperature of 45° C. or lower for 5 minutes. Next, the mixture obtained was poured into an open roll-type two-roll continuous kneader (Kneadex MOS-160 Model (manufactured by Nippon Coke & Engineering Co., Ltd.)), and kneaded. The kneaded product obtained was cooled and then pulverized to obtain a colored resin composition having a pigment concentration of 5% by mass.

The colored resin composition obtained was coarsely pulverized in a T250 Turbo Mill (manufactured by Turbo Kogyo Co., Ltd.) to obtain a coarsely pulverized product having an average particle diameter of about 10 μm. To 100 g of the coarsely pulverized product obtained, 2 g of an anionic surfactant (EMAL E27C (manufactured by Kao Corporation)) and 50 g of a 0.1 N aqueous sodium hydroxide solution (basic substance), ion-exchanged water was added as an aqueous medium to prepare a slurry of 500 g in total. The slurry obtained was poured into a pressure-proof round-bottom stainless container, and the slurry was shear-dispersed for 30 minutes at a rotor speed of 20,000 rpm while the slurry was heated to 145° C. and pressurized to a pressure of 0.5 MPa (G) by using a CLEARMIX high-speed shearing emulsifier (CLM-2.2S, (manufactured by M. Technique Co., Ltd.)). Thereafter, the slurry was cooled at a rate of 5° C./min while stirring was continued at a rotor speed of 15,000 rpm until the internal temperature of the stainless container was lowered to 50° C., thereby producing an aqueous dispersion (P-1) containing colored resin fine particles whose solids concentration was 20% by mass where an average particle diameter of the fine particles was 250 nm. The average particle diameter of the fine particles was measured with a particle diameter-measuring device (LA-950 (manufactured by Horiba, Ltd.)).

Preparation Example 2

Preparation of Aqueous Dispersion Containing Release Agent Fine Particles

An aqueous dispersion containing release agent fine particles was prepared by the following method. 200 g of a release agent (WEP-5, pentaerythritol behenic acid ester wax, melting point 84° C., (manufactured by NOF Corporation)), 2 g of an anionic surfactant (EMAL E27C, (manufactured by Kao Corporation)), and 800 g of ion-exchanged water were mixed. The mixture obtained was heated to 100° C. to melt the release agent. The mixture containing the molten release agent was emulsified for 5 minutes by using a homogenizer (ULTRA-TURRAX T50, (manufactured by IKA K. K.)). Then the second emulsifying treatment was performed at 100° C. in a high-pressure type homogenizer (NANOMIZER NV-200, (manufactured by Yoshida Kikai CO., LTD.)). In this way, an aqueous dispersion (W-1) that contained release agent fine particles having an average particle diameter of 150 nm and a solids concentration of 20% by mass was obtained.

Preparation Example 3

Preparation of Aqueous Dispersions a to f Containing Ethylene-Acrylic Acid Copolymer Fine Particles Into a tightly closable pressure-proof glass container including a stirrer equipped with a stirring blade, a thermometer and a heater and having a volume of 1 L, 50 g of an ethylene-acrylic acid copolymer of the brands shown in Table 1 (each manufactured by DUPONT-MITSUI POLYCHEMICALS CO., LTD.), 175 g of n-propanol, 17.6 g of triethylamine and 257.4 g of distilled water were poured. After the pressure-proof glass container was tightly closed, the contents of the container were stirred with the stirrer at a rotation speed of 400 rpm for 1 hour. Then the contents of the container were heated to 170° C. while being stirred at a rotation speed of 400 rpm. After heating, the contents of the container were further stirred at the same temperature for 60 minutes. Thereafter, the contents of the container were cooled to a temperature of 80° C. for 1 hour while the contents of the container were stirred at a rotation speed of 400 rpm with the stirrer. Then the lower half part of the glass container was immersed in water to cool the contents of the container, and stirring was stopped after the internal temperature of the container reached 35° C. The contents of the glass container were filtered on a stainless filter (460 mesh) to obtain an aqueous dispersion containing ethylene-acrylic acid copolymer fine particles, which had a solids concentration of 20% by mass. The average particle diameter of fine particles contained in the aqueous dispersion was 150 nm.

The content of units derived from acrylic acid (hereinafter, also referred to as acrylic acid units) of the ethylene-acrylic acid copolymer used for preparation of the aqueous dispersion containing fine particles of the ethylene-acrylic acid copolymer, the melt flow rate (MFR), the softening point and the melting point are described in Table 1. The content of acrylic acid units of the ethylene-acrylic acid copolymer described in Table 1 is a quantity measured by the FT-IR method. The softening point described in Table 1 is the Vicat softening point measured in accordance with JIS K7206: 1999. The melting point described in Table 1 is a value measured in accordance with JIS K7121: 1987. The melt flow rate was measured in accordance with JIS K7210: 1999 (190° C., load 2.16 kg) with a melt indexer (G-01, manufactured by Toyo Seiki Seisaku-Sho, Ltd.).

TABLE 1

| Dispersion | Type of ethylene-acrylic acid copolymer | Content of acrylic acid unit (% by mass) | MFR (g/10 min.) | Softening point (° C.) | Melting point (° C.) |
|---|---|---|---|---|---|
| a | N1035 | 10 | 35 | 71 | 95 |
| b | N1050H | 10 | 500 | 62 | 95 |
| c | N1110H | 11 | 100 | 68 | 95 |
| d | N1560 | 15 | 60 | 60 | 90 |
| e | N035C | 10 | 35 | 54 | 86 |
| f | N0200H | 2 | 130 | 52 | 88 |

Preparation Example 4

Preparation of Aqueous Dispersions g and h Containing Ethylene-Vinyl Acetate Copolymer Fine Particles An aqueous dispersion having a solids concentration of 20% by mass, which contained fine particles of an ethylene-vinyl acetate copolymer with an average particle diameter of 150 nm, was obtained in the same manner as in Preparation Example 3 except that an ethylene-vinyl acetate copolymer of the brands shown in Table 2 (each manufactured by DUPONT-MITSUI POLYCHEMICALS CO., LTD.) was used in place of the ethylene-acrylic acid copolymer. The melt flow rate (MFR), softening point and melting point of the ethylene-vinyl acetate copolymer used for preparation of the ethylene-vinyl acetate copolymer fine particle dispersion are described in Table 2. The MFR, softening point and melting point described in Table 2 are values measured in the same manner as that used for the case of ethylene-acrylic acid copolymer.

TABLE 2

| Dispersion | Type of ethylene-vinyl acetate copolymer | MFR (g/10 min.) | Softening point (° C.) | Melting point (° C.) |
|---|---|---|---|---|
| g | EV220 | 150 | 31 | 65 |
| h | EV310 | 400 | 30 | 66 |

Preparation Example 5

Preparation of Aqueous Dispersion Containing Resin Fine Particles

In 100 g of ethyl acetate, 100 g of a charge control resin (FCA-207P (manufactured by Fujikura Kasei Co. Ltd.), styrene-acrylic resin, mass-average molecular mass 26,800, glass transition point 58° C.) was dissolved at 80° C. to obtain an ethyl acetate solution of a charge control resin.

Then 1000 g of ion-exchanged water and 2.36 g of a non-ionic surfactant (Naro Acty N200 (manufactured by Sanyo Chemical Industries, Ltd.)) were put in a reaction vessel (separable flask) equipped with a thermometer, a stirrer and a nitrogen inlet pipe. The reaction vessel was placed on a mantle heater, and nitrogen gas was introduced into the reaction vessel through the glass nitrogen inlet pipe to produce an inert atmosphere in the reaction vessel. Then the internal temperature of the reaction vessel was elevated to 80° C. while the contents of the reaction vessel were stirred. Thereafter, the ethyl acetate solution of a charge control resin was added to the reaction vessel while the contents of the reaction vessel were stirred. The contents of the reaction vessel were put in an emulsifying and dispersing apparatus (CLEARMIX W-Motion (manufactured by M Technique Co., Ltd.)), and subjected to emulsifying treatment at a speed of 20,000 rpm for 30 minutes to obtain an aqueous dispersion (S-1) containing resin fine particles having an average particle diameter of 220 nm. The pH of the aqueous dispersion (S-1) containing resin fine particles was adjusted to 8 with a 5N aqueous sodium hydroxide solution.

Preparation Example 6

Preparation of Hydrophobic Silica

In 600 g of toluene, 100 g of silica fine particles (Aerosil 50 (manufactured by Nippon Aerosil Co., Ltd.)) having a BET specific surface area of 50 $m^2/g$ and a number-average particle diameter of 30 nm were dispersed. To the dispersion of silica fine particles in toluene was added 7.3 g of 3-aminopropyltrimethoxysilane, followed by stirring/mixing of the dispersion at a speed of 300 rpm for 15 minutes with a stirrer (EP1800 Three-One Motor (manufactured by Shinto Scientific Co., Ltd.)). Then trifluoropropyltrimethoxysilane was added to the dispersion, followed by stirring/mixing of the dispersion for 15 minutes. The dispersion containing silica hydrophobized by treatment with silane was heated at reduced pressure using a rotary evaporator (RE801 (manufactured by Yamato Scientific Co., Ltd.)), so that the dispersion was freed from the solvent by distillation, and was dried to the solid state until the weight bottomed out. Thereafter, drying was performed with a vacuum dryer (DP63P (manufactured by Yamato Scientific Co., Ltd.)) to obtain a coarse powder of silica. The coarse silica powder was crushed in a Waring blender (Model 7012S (manufactured by Osaka Chemical Co., Ltd.)), and collected in a bag filter to obtain hydrophobic silica.

Examples 1 to 6 and Comparative Examples 1 to 3

(Step (I): Aggregation Step)

In a stainless round-bottom flask having a volume of 2 L, 450 g of the aqueous dispersion (P-1) containing colored resin fine particles and 50 g of the aqueous dispersion (W-1) containing release agent fine particles were put and mixed at 25° C. Then a 1N aqueous sodium hydroxide solution was added to the flask while the contents of the flask were stirred at a speed of 100 rpm with a stirring blade; the pH of the mixed liquid was thereby adjusted to 11. Thereafter, the contents of the flask were stirred at 25° C. for 10 minutes, followed by the addition 17 g of an aggregating agent (aqueous magnesium chloride solution with a concentration of 50% by mass) to the flask over a 5-minute period. After the aggregating agent was added, the internal temperature of the flask was elevated to 40° C. at a rate of temperature increase of 0.2° C./minute, and the contents of the flask were stirred at the same temperature for 30 minutes to aggregate colored resin fine particles and release agent fine particles. Thereafter, 50 g of an aqueous sodium chloride solution with a concentration of 20% by mass was added to the flask at once to stop aggregation of fine particles, thereby producing an aqueous dispersion containing toner core particles as aggregated particles.

Step (II)

While the aqueous dispersion containing toner core particles obtained in step (I) was stirred at a speed of 100 rpm, 50 g of an aqueous dispersion containing ethylene-acrylic acid copolymer fine particles of the type described in Table 3 or an aqueous dispersion containing ethylene-vinyl acetate copolymer fine particles was added to the flask thereby producing an aqueous dispersion containing ethylene-acrylic acid copolymer fine particles or ethylene-vinyl acetate copolymer fine particles and toner core particles.

Step (III)

Then the internal temperature of the flask was increased to 75° C., followed by keeping the temperature of the contents of the flask at the same temperature for 2 hours while the aqueous dispersion was stirred at a speed of 100 rpm, thereby producing an aqueous dispersion containing toner core particles with ethylene-acrylic acid copolymer fine particles or ethylene-vinyl acetate copolymer fine particles attached on the surface.

Step (IV)

The aqueous dispersion obtained in step (III) was added to a flask containing the aqueous dispersion (S-1) containing resin fine particles as obtained in Preparation Example 5, which had a solid content of 50.5 g, thereby producing an aqueous dispersion containing toner core particles with ethylene-acrylic acid copolymer fine particles or ethylene-vinyl acetate copolymer fine particles attached on the surface, and resin fine particles.

Step (V)

Magnesium chloride as an aggregating agent was added to and dissolved in the aqueous dispersion containing toner core particles with ethylene-acrylic acid copolymer fine particles or ethylene-vinyl acetate copolymer fine particles attached on the surface, and resin fine particles as obtained in step (IV). Then the internal temperature of the flask was elevated to 60° C. at a rate of 1° C./minute while the aqueous dispersion was stirred at a speed of 100 rpm, thereby coating toner core particles with resin fine particles. Thereafter, an aqueous sodium chloride solution prepared by dissolving 71.5 g of sodium chloride in 288 g of ion-exchanged water was added to the flask. Then the internal temperature of the flask was increased to 95° C. at a rate of temperature increase of 1° C./minute, followed by stirring of the aqueous dispersion in the flask at the same temperature for 2 hours to transform the resin fine particle layer with which toner core particles were coated to a film, thereby forming shell layers. After the shell layers were formed, the internal temperature of the flask was lowered to 25° C. at a rate of 10° C./minute. Then hydrochloric acid was added to the flask to adjust the pH of the aqueous dispersion in the flask to 2, thereby producing an aqueous dispersion containing toner base particles. The fine particles (toner base particles) had an average particle diameter of 5.5 μm and a sphericity of 0.978.

(VI) Cleaning Step

The aqueous dispersion containing toner base particles was suction-filtered, and a wet cake of toner base particles was collected by filtering. Then the wet cake was redispersed in ion-exchanged water to clean the toner base particles. Similar procedures were repeated 5 times to clean the toner base particles, followed by filtration and collection of a wet cake of toner base particles.

(VII) Drying Step

The wet cake of toner base particles was dispersed in an aqueous ethanol solution with a concentration of 50% by mass to prepare a slurry. The slurry obtained was dried with a continuous surface-modifying device (COATMIZER, manufactured by Freund Corporation), thereby producing toner base particles. Conditions for drying in the COATMIZER included a hot-air temperature of 45° C. and a blower-air flow rate of 2 $m^3$/minute.

(VII) External Addition Step

In a HENSCHEL MIXER (manufactured by Mitsui Miike Machinery Co., Ltd., capacity 5 L), 100 g of the toner base particles obtained in the drying step and 1 g of hydrophobic silica obtained in Preparation Example 6 were mixed for 5 minutes. The mixture obtained was screened on a 300-mesh screen (#300 mesh, mesh size 48 μm), and powders passing through the screen were collected to obtain toner particles (toners) of Examples 1 to 6 and Comparative Examples 1 to 3.

Evaluation 1

For the toners obtained in Examples 1 to 6 and Comparative Examples 1 to 3, heat-resistant storage stability was evaluated by the following method. The evaluation results on the heat-resistant storage stability of the toners of Examples 1 to 6 and Comparative Examples 1 to 3 are presented in Table 3.

Method for Evaluation of Heat-Resistant Storage Stability

Ten grams of a toner was left standing for 8 hours in a thermostat bath set at 60° C. Thereafter, 10 g of the toner left standing in the thermostat bath was placed on a screen having a mesh size of 45 μm, and a POWDER TESTER (manufactured by Hosokawa Micron Corporation) was used to apply vibrations to the screen for 60 seconds at an amplitude of 1 mm to screen the toner. After screening, a mass (T (g)) of the toner remaining on the screen having a mesh size of 45 μm was weighed, and the degree of agglomeration of the toner was calculated from the following equation.

$$\text{The degree of agglomeration (\%) of toner} = (T/10) \times 100.$$

The heat-resistant storage stability was evaluated against the following criteria.

Very Good: the degree of agglomeration of the toner was less than 10%;

Good: the degree of agglomeration of the toner was less than 20%; and

Poor: the degree of agglomeration of the toner was at least 20%.

Evaluation 2

For the toners obtained in Examples 1 to 6 and Comparative Examples 1 to 3, evaluations of low-temperature fixability and stress resistance, which gives an indication as to whether or not crushing of toner resulting from long-term stress is suppressed, were performed by the following method. For evaluation of low-temperature fixability and stress resistance, a color printer modified so that the fixing temperature could be controlled (a color printer with an FS-C5400N fixing unit (manufactured by Kyocera Mita Corp.) modified so that the fixing temperature could be controlled in the temperature range for the fixing test) was used. Plain paper was used as a recording medium. For the evaluations of low-temperature fixability and stress resistance, a two-component developer prepared by the following method was used. Evaluation results of the toners of Examples 1 to 6 and Comparative Examples 1 to 3 are presented in Table 3.

Preparation Example 7

Preparation of Carrier

Raw materials were compounded so as to result in 39.7 mol % MnO, 9.9 mol % MgO, 49.6 mol % $Fe_2O_3$ and 0.8 mol % SrO, and water was added to the raw materials. Then the raw materials including water were pulverized/mixed for 10 hours in a wet ball mill. The mixture obtained was dried, and then the temperature of the mixture was raised to 950° C. and maintained at the same temperature for 4 hours. Then the mixture was cooled and pulverized for 24 hours in a wet ball mill to prepare a slurry. A granulated product was obtained by granulating and drying of the slurry, and the temperature of the granulated product was raised to 1270° C. and maintained at the same temperature for 6 hours in an atmosphere having an oxygen concentration of 2%, then the granulated product was cooled, crushed and subjected to particle-size adjustment to obtain manganese ferrite particles (carrier core material). The manganese ferrite particles obtained had an average particle diameter of 35 μm and a saturated magnetization of 70 $Am^2/kg$ in an applied magnetic field of 3000 ($10^3/4\pi \cdot A/m$).

A polyamide-imide resin (copolymer of trimellitic anhydride and 4,4'-diaminodiphenyl methane) was diluted with methyl ethyl ketone to prepare a resin solution. A tetrafluoroethylene-hexafluoropropylene copolymer (FEP) and silicon oxide (2% by mass based on the total amount of resin) were dispersed in the resin solution to obtain a carrier-coating liquid containing 150 g of solid content. The mass ratio of polyamide-imide resin to FEP was 2/8 as polyamide-imide resin/FEP. The solids-content ratio of the resin solution was 10% by mass.

By using a fluidized-bed coating device (Spiracoater SP-25, manufactured by Okada Seiko Co., Ltd.), 10 kg of manganese ferrite particles was coated with the carrier coating liquid obtained. Thereafter, the manganese ferrite particles coated with the resin were baked at 220° C. for 1 hour to obtain a resin-coated ferrite carrier having a coated-resin content of 1.5% by mass.

Preparation of Two-Component Developer

A two-component developer was prepared by mixing the resin-coated ferrite carrier obtained with each of the toners obtained in Examples 1 to 6 and Comparative Examples 1 to 3 so that the toner concentration in the two-component developer was 10% by mass.

Good: minimum fixing temperature was above 110° C. and below 120° C.; and

Poor: minimum fixing temperature was at least 120° C.

Method for Evaluation of Stress Resistance

In an environment of 23° C. and 50% RH, 1000 sheets of blank images were formed continuously with the color printer. Thereafter, the toner particles (toner) were removed from the developing unit, and the toner was observed at 1000× magnification under a reflection electron microscope. For 500 toner particles observed under the reflection electron microscope, observations were made 5 times with change of field of view, and the number of crushed toner particles was counted. Stress resistance was evaluated against the following criteria.

Very Good: no crushed toner particles were observed;

Good: a small number of crushed toner particles were observed; and

Poor: a large number of crushed toner particles were observed.

Overall Evaluation

Based on the evaluation results for low-temperature fixability, stress resistance and heat-resistance storage stability, overall ratings were made of the characteristics of the toners obtained in Examples 1 to 6 and Comparative Examples 1 to 3. Toners that were rated "Very Good" or "Good" for all parameters—low-temperature fixability, stress resistance and heat-resistant storage stability—were rated "Good" in the overall rating. Toners that were rated "Poor" for at least one of the parameters—low-temperature fixability, stress resistance and heat-resistant storage stability—were rated "Poor" in the overall rating.

TABLE 3

| | Ethylene-acrylic acid copolymer or Ethylene-vinyl acetate copolymer | | | Evaluation results | | | |
|---|---|---|---|---|---|---|---|
| | Type | Content of acrylic acid unit (% by mass) | MFR (g/10 min.) | Low-temperature fixability (Fixing temperature (° C.)/Evaluation) | Stress resistance | Heat-resistant storage stability (Degree of aggregation (%)/ Evaluation) | Overall Evaluation |
| Ex. 1 | a | 10 | 35 | 118/Good | Very Good | 5/Very Good | Good |
| Ex. 2 | b | 10 | 500 | 105/Very Good | Very Good | 5/Very Good | Good |
| Ex. 3 | c | 11 | 100 | 110/Very Good | Very Good | 5/Very Good | Good |
| Ex. 4 | d | 15 | 60 | 115/Good | Very Good | 5/Very Good | Good |
| Ex. 5 | e | 10 | 35 | 118/Good | Very Good | 8/Very Good | Good |
| Ex. 6 | f | 2 | 130 | 110/Very Good | Good | 18/Good | Good |
| Comp. Ex. 1 | — | — | — | 107/Good | Poor | 20/Poor | Poor |
| Comp. Ex. 2 | g | — | 150 | 110/Very Good | Poor | 27/Poor | Poor |
| Comp. Ex. 3 | h | — | 400 | 108/Very Good | Poor | 27/Poor | Poor |

Method for Evaluation of Low-Temperature Fixability

The two-component developer was installed in the developing unit of a color printer, and a toner cartridge was filled with the toner, followed by forming an unfixed image having a quantity of 0.5 $mg/cm^2$ applied to the recording medium by using the color printer. Then fixation was performed while the fixing temperature was changed within the range from 80° C. to 180° C. (inclusively), and the minimum fixing temperature at which offset did not occur was measured. Low-temperature fixability was evaluated against the following criteria. A rating of "Very Good" or "Good" corresponds to acceptance.

Very Good: minimum fixing temperature was no higher than 110° C.;

From Examples 1 to 6 it is apparent that in a toner for electrostatic latent-image development including toner particles each containing a toner core particle including at least a binder resin and a shell layer with which the entire surface of the toner core particle is coated, when an ethylene-unsaturated carboxylic acid copolymer is present at the interface between the toner core particle and the shell layer, a toner is obtained that has excellent storage stability and low-temperature fixability and the toner particles in the toner are inhibited from being crushed as a result of long-term stress.

From Table 3 it is apparent that it becomes easier to obtain a toner with excellent low-temperature fixability as the MFR of the ethylene-unsaturated carboxylic acid copolymer increases.

From Comparative Example 1, it is apparent that when an ethylene-unsaturated carboxylic acid copolymer is not present at the interface between the toner core particle and the shell layer, it is difficult to obtain a toner with excellent heat-resistant storage stability that the toner particles are inhibited from being crushed as a result of long-term stress. From Comparative Examples 2 and 3, it is apparent that when an ethylene-vinyl acetate copolymer is present but an ethylene-unsaturated carboxylic acid copolymer is not present at the interface between the toner core particle and the shell layer, it is difficult to obtain a toner with excellent heat-resistant storage stability that the toner particles are inhibited from being crushed as a result of long-term stress.

The invention claimed is:

1. A toner for electrostatic latent-image development, which comprises: toner core particles including at least a binder resin; and shell layers with which the toner core particles are coated, wherein an ethylene-unsaturated carboxylic acid copolymer is present at the interface between the toner core particle and the shell layer, and the shell layer includes a (meth)acrylic resin and/or a styrene-(meth)acrylic resin.

2. The toner for electrostatic latent-image development according to claim 1, wherein the unsaturated carboxylic acid is (meth)acrylic acid.

3. The toner for electrostatic latent-image development according to claim 1, wherein the melt flow rate of the ethylene-unsaturated carboxylic acid copolymer at 190° C. under a load of 2.16 kg is 100 g/10 minutes or higher and 500 g/10 minutes or lower.

4. A method for producing a toner for electrostatic latent-image development according to claim 1, wherein the method comprises steps (I) to (V):

(I) obtaining an aqueous dispersion (A) containing fine particles including a binder resin, followed by aggregation of the fine particles in the presence of an aggregating agent to obtain an aqueous dispersion (B) containing toner core particles;

(II): mixing the aqueous dispersion (B) with an aqueous dispersion (C) containing fine particles including an ethylene-unsaturated carboxylic acid copolymer to obtain an aqueous dispersion (D) containing the toner core particles and the fine particles including the ethylene-unsaturated carboxylic acid copolymer;

(III): heating the aqueous dispersion (D) to obtain an aqueous dispersion (E) containing toner core particles with the fine particles including the ethylene-unsaturated carboxylic acid copolymer attached on surfaces;

(IV): mixing the aqueous dispersion (E) with an aqueous dispersion (F) containing resin fine particles to obtain an aqueous dispersion (G) containing toner core particles with the fine particles including the ethylene-unsaturated carboxylic acid copolymer attached on the surfaces, and the resin fine particles; and (V): obtaining toner particles by heating the aqueous (G) to form shell layers on the surfaces of the toner core particles.

* * * * *